US008010018B2

(12) United States Patent
Okabe

(10) Patent No.: US 8,010,018 B2
(45) Date of Patent: Aug. 30, 2011

(54) DISCHARGER AND PROCESS CARTRIDGE

(75) Inventor: Yasushi Okabe, Chikusa-ku (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 176 days.

(21) Appl. No.: 12/408,767

(22) Filed: Mar. 23, 2009

(65) Prior Publication Data

US 2009/0324287 A1 Dec. 31, 2009

(30) Foreign Application Priority Data

Jun. 25, 2008 (JP) ..... 2008-165965

(51) Int. Cl.
*G03G 21/00* (2006.01)

(52) U.S. Cl. ..... 399/128; 399/168

(58) Field of Classification Search ..... 399/128, 399/168

See application file for complete search history.

(56) References Cited

U.S. PATENT DOCUMENTS

| | | | | |
|---|---|---|---|---|
| 5,584,556 | A | 12/1996 | Yokoyama et al. | |
| 6,738,588 | B2 | 5/2004 | Yokomori et al. | |
| 2002/0081126 | A1 | 6/2002 | Yokomori et al. | |
| 2004/0071436 | A1 * | 4/2004 | Kwon | 385/146 |

FOREIGN PATENT DOCUMENTS

| | | | |
|---|---|---|---|
| JP | 62-127786 | | 6/1987 |
| JP | 63-133102 | A | 6/1988 |
| JP | 5-079537 | U | 10/1993 |
| JP | 11-224521 | A | 8/1999 |
| JP | 2002189400 | | 7/2002 |

OTHER PUBLICATIONS

JP Office Action dtd Apr. 20, 2010, JP Appln. 2008-165965, English translation.

* cited by examiner

*Primary Examiner* — Ryan D Walsh
(74) *Attorney, Agent, or Firm* — Banner & Witcoff, Ltd.

(57) ABSTRACT

A discharger is provided, which can eliminate charge from a surface of a photoconductor. The discharger includes: a light source; and a light guide member which extends in a first direction to be opposed to the surface of the photoconductor in a second direction substantially orthogonal to the first direction. The light guide member has a plurality of holes, each defined by a hole surface. At least a portion of the hole surface is curved. The hole extends in an orthogonal direction substantially orthogonal to the first and second directions.

12 Claims, 8 Drawing Sheets

DISCHARGER AND PROCESS CARTRIDGE

CROSS REFERENCE TO RELATED APPLICATION

The present disclosure relates to the subject matter contained in Japanese patent application No. 2008-165965 filed on Jun. 25, 2008, which is expressly incorporated herein by reference in its entirety.

TECHNICAL FIELD

The present invention relates to an image forming apparatus and, in particular, to a discharger which can eliminate remaining charge from a photoconductor. The present invention also relates to a process cartridge.

BACKGROUND ART

An electrophotographic image forming apparatus including a photoconductor is known. In this apparatus, an electrostatic latent image is formed on a surface of a charged photoconductor, the latent image is developed into a developer image by developer, and the developer image is transferred onto a recording medium to form an image on the medium. After the developer image is transferred onto the recording medium, a discharger eliminates remaining charge from the surface of the photoconductor as preparation for next image formation.

Patent Document 1 discloses a photoelectric discharger as an example of the discharger. The photoelectric discharger includes an optical fiber extending in a direction of a central axis of the photoconductor to face an outer peripheral surface of a photoconductive drum, and a lamp, i.e. a light source, disposed alongside the photoconductive drum in the central axis direction.

The optical fiber has a core, i.e. a bar-like transparent glass, a clad, i.e. a cylindrical transparent glass or the like covering the core, and a reflecting tape attached to the outer periphery of the clad. The outer peripheral surface of the core has a diffusion surface formed as a consequence of fine irregularity processing.

The photoelectric discharger operates as follows: Light emitted from the lamp enters the optical fiber, and is reflected by the reflecting tape toward the diffusion surface. The light is diffused by the diffusion surface to enter the core, and then irradiated onto the outer peripheral surface of the photoconductive drum while being reflected by the boundary between the core and the clad. Accordingly, the outer peripheral surface of the photoconductive drum is exposed, and charges remaining on the outer peripheral surface of the photoconductive drum are eliminated therefrom.

Patent Document 1: Japanese Published Unexamined Patent Application No. S62-127786

The photoelectric discharger disclosed in Patent Document 1 is complicated in configuration because the number of components (core, clad, and reflecting tape, etc.) of the optical fiber is large and the diffusion surface must be formed on the core by applying irregularity processing.

The optical fiber also suffers from a problem in that light emitted from the lamp hardly reaches a position distant from the lamp in the central axis direction of the photoconductive drum. Therefore, the light irradiation amount onto the outer peripheral surface of the photoconductive drum from the optical fiber at this distant position is smaller than the irradiation amount at a position close to the lamp. In this case, it is difficult to eliminate charges uniformly across the central axis direction from the outer peripheral surface of the photoconductive drum. Accordingly, when charging the photoconductive drum for next image formation, the outer peripheral surface of the photoconductive drum is hardly charged uniformly across the central axis direction, and this causes fluctuation in density of the developer image transferred on the recording medium in the central axis direction of the photoconductive drum, and satisfactory image formation may not be realized.

SUMMARY

The present invention was made in view of the above-noted and other circumstances.

As one of illustrative, non-limiting embodiment, the present invention can provide a discharger is provided, which can eliminate charge from a surface of a photoconductor. The discharger includes: a light source; and a light guide member which extends in a first direction to be opposed to the surface of the photoconductor in a second direction substantially orthogonal to the first direction. The light guide member has a plurality of holes, each defined by a hole surface. At least a portion of the hole surface is curved. The hole extends in an orthogonal direction substantially orthogonal to the first and second directions.

As another one of illustrative, non-limiting embodiment, the present invention can provide a process cartridge to be installed in an image forming apparatus. The process cartridge includes: a photoconductor; and a light guide member which extends in a first direction to be opposed to a surface of the photoconductor in a second direction substantially orthogonal to the first direction. The light guide member has a plurality of holes, each defined by a hole surface. At least a portion of the hole surface is curved. The hole extends in an orthogonal direction substantially orthogonal to the first and second directions.

Accordingly, as an advantage, the present invention can provide a discharger of a simple configuration. As another advantage, the present invention can provide a discharger which can eliminate charge from a surface of a photoconductor uniformly. As yet another advantage, the present invention can provide a featured process cartridge.

These and other advantages will be discussed in detail with reference to the accompanying drawings.

DESCRIPTION OF THE PREFERRED EMBODIMENT

Hereinafter, a process cartridge 1, which is an exemplary embodiment according to the present invention, will be described with reference to the drawings.

<Outline of Process Cartridge>

Figure 1:
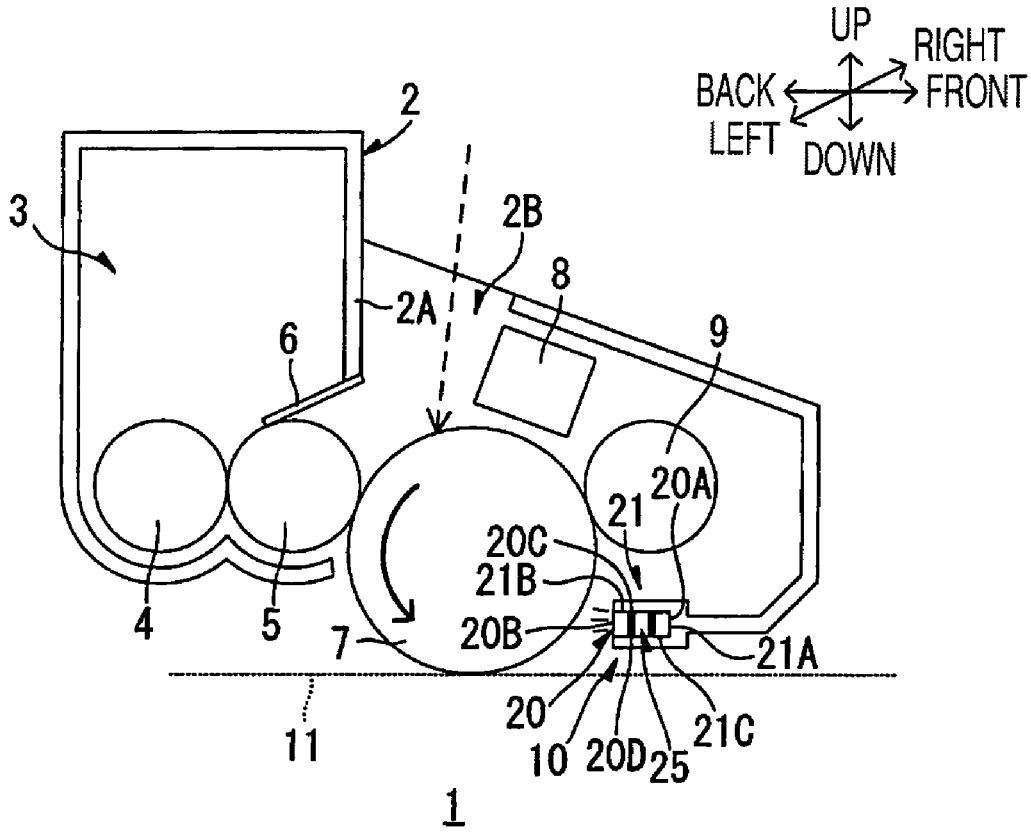
FIG. 1 is a schematic left side sectional view showing a process cartridge according to an exemplary embodiment of the present invention.

FIG. 1 is a schematic left side sectional view showing the process cartridge 1. In FIG. 1, arrows (direction arrows) indicating up, down, front, back, left, and right are shown, and the arrows are referred to for identifying a direction (the same applies to the drawings subsequent to FIG. 1). Here, the front side in the drawing paper thickness direction in FIG. 1 is the left side, and the back side in the drawing paper thickness direction in FIG. 1 is the right side. The right-left direction and the width direction are the same. The horizontal direction includes the front-back direction and the right-left direction. These directions are used to explain the structure of the process cartridge 1 and to facilitate the understanding of the structure, and therefore should not be interpreted in a restrictive sense.

The process cartridge 1 is installed in a casing (image forming apparatus casing) of an electrophotographic image forming apparatus (not shown) such as a laser printer and functions as an essential portion for image formation.

The process cartridge 1 includes a housing 2, a developer accommodation chamber 3, a supply roller 4, a developing roller 5, a layer thickness restricting blade 6, a photoconductive drum 7 as an example of a photoconductor, a charger 8, a cleaning roller 9, and a discharger 10.

The housing 2 has a hollow box shape, and inside the housing 2, the developer accommodation chamber 3, the supply roller 4, the developing roller 5, the layer thickness restricting blade 6, the photoconductive drum 7, the charger 8, the cleaning roller 9, and the discharger 10 are disposed.

The developer accommodation chamber 3 is a space partitioned on the back side inside the housing 2. The developer accommodation chamber 3 accommodates therein, for example, positively-charged nonmagnetic single-component toner as an example of developer.

The supply roller 4 is supported rotatably by the housing 2 so that the central axis thereof extends in the width direction at the lower end of the developer accommodation chamber 3. Accordingly, the toner in the developer accommodation chamber 3 is always accumulated on the outer peripheral surface of the supply roller 4 due to its own weight.

The developing roller 5 is supported rotatably by the housing 2 so that the central axis thereof extends in the width direction. The developing roller 5 is disposed at a front side of the supply roller 4, and is pressure-contacted with the supply roller 4.

The layer thickness restricting blade 6 is an elastic member extending from a wall 2A (partitioning the developer accommodation chamber 3 in the housing 2) backward and downward toward the developing roller 5, and a tip end (lower end) thereof is pressure-contacted with the upper side outer peripheral surface of the developing roller 5.

The photoconductive drum 7 has a cylindrical shape, and is supported rotatably by the housing 2 so that the central axis thereof extends in the width direction. The photoconductive drum 7 is disposed at a front side of the developing roller 5, and is pressure-contacted with the developing roller 5. The photoconductive drum 7 rotates counterclockwise in FIG. 1 (see the illustrated thick arrow). The outer peripheral surface of the lower side of the photoconductive drum 7 is exposed downward from the housing 2. The outer peripheral surface of the photoconductive drum 7 (outermost layer) is formed of a positively-chargeable photoconductive layer made of, for example, polycarbonate. An upper wall of the housing 2 above the photoconductive drum 7 has a communicating hole 2B, through which the inside and the outside of the housing 2 communicate with each other.

The charger 8 is, for example, a scorotron type charger, and is supported by the housing 2 to be located above the photoconductive drum 7. The charger 8 is opposed to the outer peripheral surface of the photoconductive drum 7 with a distance.

A cleaning roller 9 is supported rotatably by the housing 2 so that its central axis extends in the width direction. The cleaning roller 9 is located at a front side of the photoconductive drum 7 to be pressure-contacted with the photoconductive drum 7. The outer peripheral surface of the cleaning roller 9 is coated with, for example, a conductive foam material. To the cleaning roller 9, a cleaning bias is applied.

The discharger 10 is supported by the housing 2. The discharger 10 is disposed at a front side of the photoconductive drum 7 and below the cleaning roller 9 to be opposed to the outer peripheral surface of the photoconductive drum 7 with a distance. The discharger 10 will be described in detail later.

During image formation, toner accumulated on the supply roller 4 in the developer accommodation chamber 3 enters between the tip end of the layer thickness restricting blade 6 and the developing roller 5 as the supply roller 4 and the developing roller 5 rotate, to form a thin toner layer carried on the outer peripheral surface of the developing roller 5.

The outer peripheral surface of the photoconductive drum 7 is positively charged uniformly across the width direction by the charger 8, and then exposed to a laser beam (see the dashed-line arrow in FIG. 1) irradiated via the communicating hole 2B of the housing 2 from the image forming apparatus casing side (not shown). Accordingly, an electrostatic latent image based on image data is formed on the outer peripheral surface of the photoconductive drum 7.

As the photoconductive drum 7 and the developing roller 5 rotate, the toner carried on the outer peripheral surface of the developing roller 5 is supplied to the electrostatic latent image on the outer peripheral surface of the photoconductive drum 7. Accordingly, the electrostatic latent image is developed (visualized) as a toner image carried on the outer peripheral surface of the photoconductive drum 7.

As the photoconductive drum 7 further rotates, the toner image is exposed downward from the housing 2, where the toner image is transferred onto a recording medium 11. The toner image transferred onto the recording medium 11 is heat-fixed. This way, image formation is completed.

Here, toner may remain on the outer peripheral surface of the photoconductive drum 7 after the toner image is transferred onto the recording medium 11 from the photoconductive drum 7 (this toner is referred to as residual transfer toner, when applicable). In this case, during rotation of the photoconductive drum 7, the residual transfer toner is transferred onto the outer peripheral surface of the cleaning roller 9 by the above-described cleaning bias and captured by the cleaning roller 9. When image formation is finished, a bias opposite to the cleaning bias is applied to the cleaning roller 8, and accordingly, the residual transfer toner captured by the cleaning roller 9 is discharged to the photoconductive drum 7 from the cleaning roller 9 and then collected by the developing roller 5.

<Details of Discharger>

Next, the discharger 10 will be described in detail.

Figure 2B:
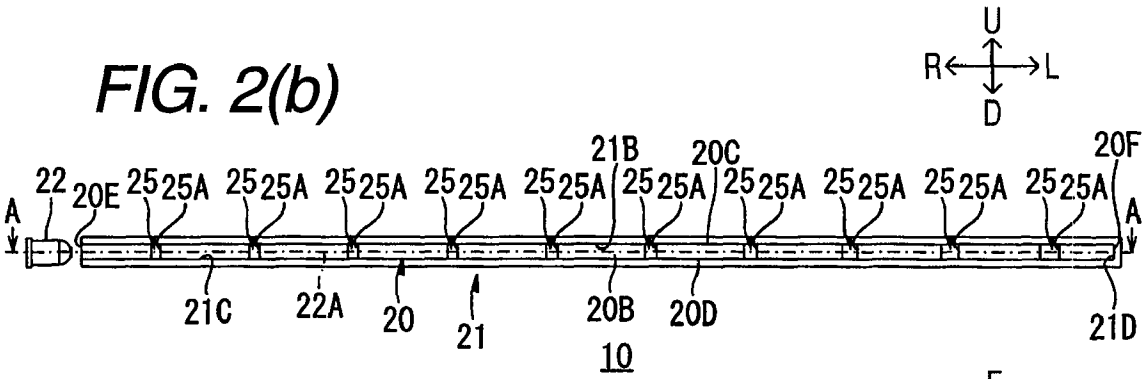
FIG. 2(*a*) is a right side view of a discharger, FIG. 2(*b*) is a back view of the discharger, and FIG. 2(*c*) is a sectional view along the arrow A-A of FIG. 2(*b*).
Figure 2C:
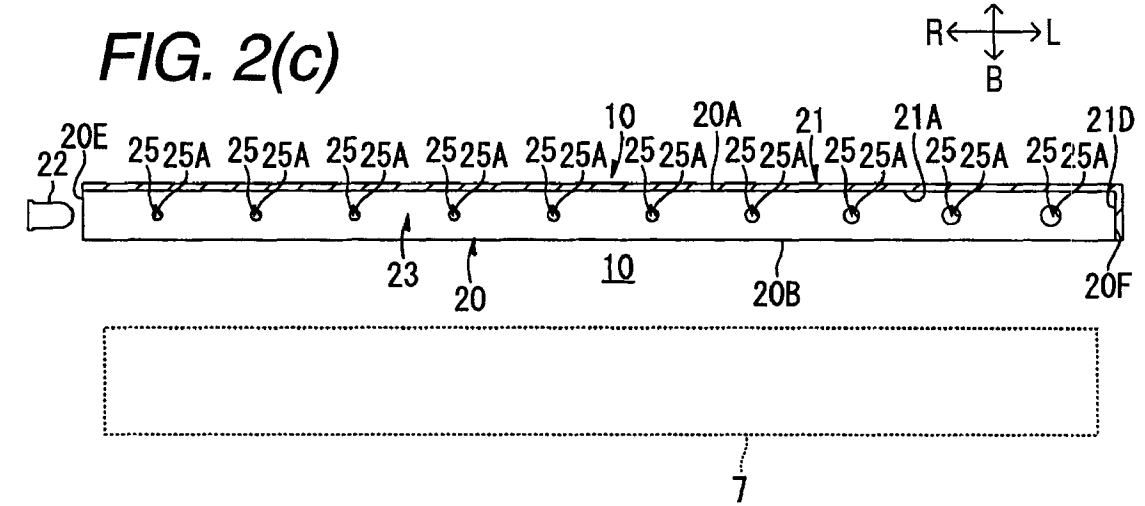
Figure 2A:
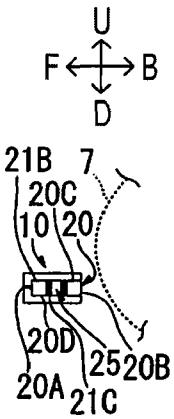
Figure 3:
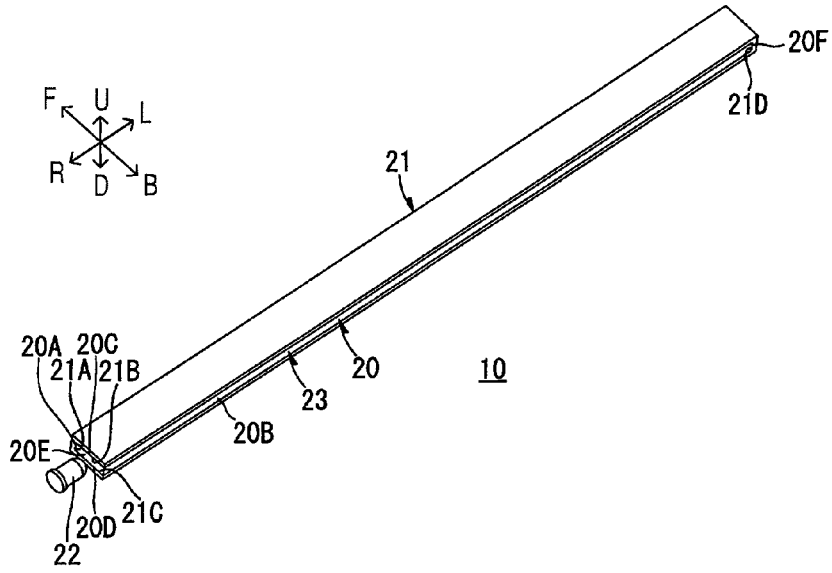
FIG. 3 is a perspective view showing the discharger of FIG. 2 from the back side.
Figure 4A:
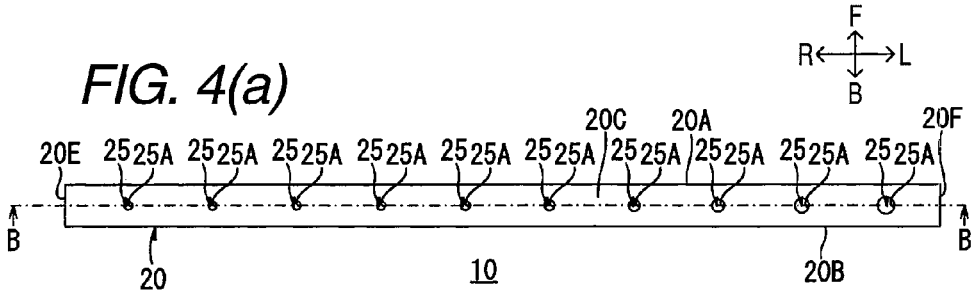
FIG. 4(*a*) is a plan view of a light guide member of a first example, and FIG. 4(*b*) is a sectional view along the arrow B-B of FIG. 4(*a*).
Figure 4B:
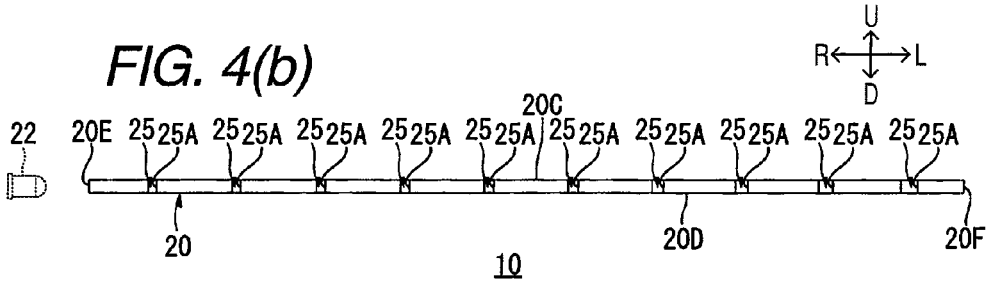
Figure 5:
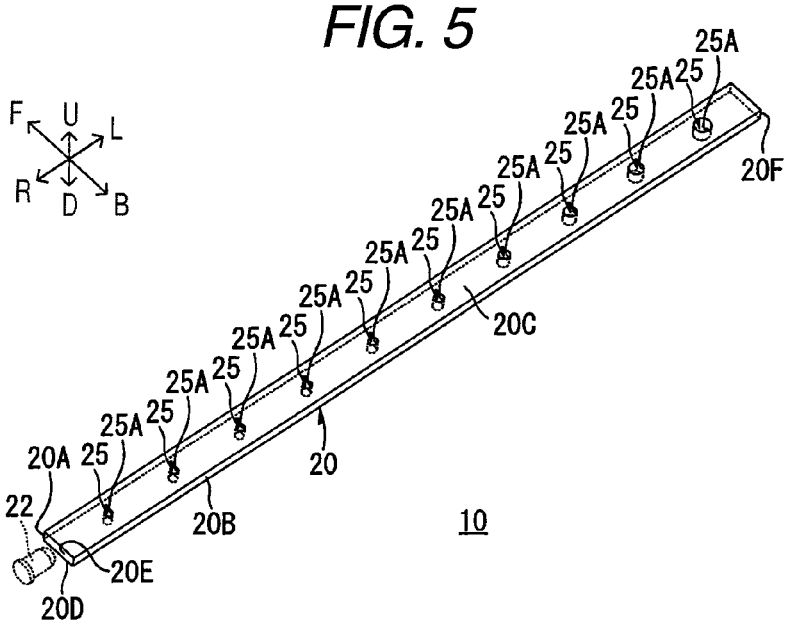
FIG. 5 is a perspective view of the light guide member of FIG. 4 from the back side.

FIG. 2(*a*) is a right side view of the discharger, FIG. 2(*b*) is a back view of the discharger, and FIG. 2(*c*) is a sectional view along the arrow A-A of FIG. 2(*b*). FIG. 3 is a perspective view showing the discharger of FIGS. 2(*a*) to 2(*c*) from the back side. FIG. 4(*a*) is a plan view of a light guide member of a first example, and FIG. 4(*b*) is a sectional view along the arrow B-B of FIG. 4(*a*). FIG. 5 is a perspective view of the light guide member of FIGS. 4(*a*) and 4(*b*) from the back side. In FIG. 2(*a*) and FIG. 2(*c*), for reference, the photoconductive drum 7 is shown by a dotted line.

Here, after the toner image is transferred, charge remains on the outer peripheral surface of the photoconductive drum 7. The remaining charge must be completely eliminated from the outer peripheral surface of the photoconductive drum 7 before the outer peripheral surface of the photoconductive drum 7 is charged for next image formation, in order that the outer peripheral surface of the photoconductive drum 7 can be charged uniformly across the width direction as described above (the potential on the outer peripheral surface after charging becomes uniform across the width direction). Therefore, each time the transfer of the toner image onto the recording medium 11 from the photoconductive drum 7 is complete, the discharger 10 eliminates remaining charges from the outer peripheral surface of the photoconductive drum 7 for next image formation.

As shown in FIG. 3, the discharger 10 includes a light guide member 20, a cover 21, and a light source 22.

As shown in FIG. 5, the light guide member 20 is, for example, a transparent bar made of acrylic resin, and is long in the width direction. As shown in FIG. 2(*c*), the light guide member 20 is disposed at a front side of the photoconductive drum 7 to be opposed to the outer peripheral surface of the photoconductive drum 7 with a distance. The right end of the light guide member 20 is located outside the right end of the photoconductive drum 7, and the left end of the light guide member 20 is located outside the left end of the photoconductive drum 7. In other words, the light guide member 20 extends along the central axis of the photoconductive drum 7, and is opposed to the entire region, in the width direction, of the outer peripheral surface of the photoconductive drum 7.

As shown in FIG. 2(*a*), the shape (right side sectional shape) of the light guide member 20 as viewed in the width direction is a rectangular shape long in the front-back direction while the four sides extend along either the up-down or front-back direction, so that the light guide member 20 is a quadrangular prism long in the width direction (see also FIG. 5). In other words, the light guide member 20 is defined by the front surface 20A and the back surface 20B having rectangular shapes extending in the up-down and right-left directions, the upper surface 20C and the lower surface 20D having rectangular shapes extending in the front-back and right-left directions, and the right surface 20E and the left surface 20F having rectangular shapes extending in the up-down and front-back directions. In the light guide member 20, the back surface 20B is opposed to the outer peripheral surface of the photoconductive drum 7 from the front side with a predetermined distance (see FIG. 2(*c*)). The left surface 20F is opposed to the right surface 20E in the right-left direction, and the back surface 20B extends in a direction crossing (in detail, substantially orthogonal to) the right surface 20E and the left surface 20F.

By using the back surface 20B as a reference, the front surface 20A is disposed at a front side of the back surface 20B at a position further distant from the photoconductive drum 7 than the back surface 20B. The front surface 20A is opposed to the back surface 20B in the front-back direction (see FIG. 2(*a*)). The upper surface 20C connects one end (upper end) of the front surface 20A and one end (upper end) of the back surface 20B, and the lower surface 20D connects the other end (lower end) of the front surface 20A and the other end (lower end) of the back surface 20B.

Here, the front surface 20A functions as an example of a second surface, and the back surface 20B functions as an example of a first surface and opposed surface. The upper surface 20C functions as an example of a third surface, and the lower surface 20D functions as an example of a fourth surface. The right surface 20E functions as an example of an incidence surface, and the left surface 20F functions as an example of an incidence opposed surface.

The light guide member 20 is formed with a plurality of holes 25 arranged at even intervals in the width direction. Each of these holes 25 is circular in a plan view (see FIG. 4(*a*)), extends in the up-down direction, and penetrates through the light guide member 20 in the up-down direction (see FIG. 4(*b*)). In other words, each hole 25 is defined by a cylindrical surface 25A of the light guide member 20. The surface 25A functions as an example of a reflecting surface. The surface 25A is cylindrical as described above, that is, at least a portion of the surface 25A is curved. The surface 25A is a rough surface having, for example, a ten-point average roughness (Rz) of approximately 12.5 to 25. The hole 25 penetrates through the light guide member 20 in the up-down direction, so that the opening end of the hole 25 is on the upper surface 20C and the lower surface 20D (see FIG. 4(*b*)), and the surface 25A is positioned between the front surface 20A and the back surface 20B (see FIG. 4(*a*)). Here, referring to FIG. 1 and FIGS. 2(*a*) to 2(*c*), the up-down direction is an orthogonal direction substantially orthogonal to the central axis direction (width direction) of the photoconductive drum 7 and an opposing direction of the photoconductive drum 7 to the light guide member 20.

As shown in FIGS. 4(*a*) and 4(*b*) and FIG. 5, opening cross-sectional areas of the holes 25 are so determined that a hole 25 located closer to the left end (the surface 20F) of the light guide member 20 has a larger cross-section area. The large opening cross-section area of the hole 25 means a large surface 25A defining the hole 25.

As shown in FIG. 3, the cover 21 has a shape slightly larger than and analogous to the shape of the light guide member 20, and in detail, the cover 21 is a quadrangular prism long in the width direction similar to the light guide member 20, but is hollow unlike the light guide member 20. Unlike the light guide member 20, the cover 21 is not transparent and does not transmit light. The back surface and the right surface of the cover 21 are continuously notched (opened), and accordingly, the inner space 23 of the cover 21 is exposed via the back surface and the right surface of the cover 21. In other words, the right side sectional shape of the cover 21 is a substantially U-shape whose back side is opened. The inner space 23 of the cover 21 has a size just capable of housing the light guide member 20. Here, the inner space 23 of the cover 21 is defined by inner surfaces of the cover 21, i.e. a front inner surface 21A at the front side, an upper inner surface 21B at the upper side, a lower inner surface 21C at the lower side and a left inner surface 21D at the left side. As described above, the back surface and the right surface of the cover 21 are continuously notched, and therefore no surfaces define the inner space 23 at the back and right sides.

Referring to FIG. 3 and FIG. 5, the front inner surface 21A has the same size as that of the front surface 20A of the light guide member 20, and extends parallel to the front surface 20A. The upper inner surface 21B has the same size as that of the upper surface 20C of the light guide member 20, and extends parallel to the upper surface 20C. The lower inner surface 21C has the same size as that of the lower surface 20D of the light guide member 20, and extends parallel to the lower surface 20D. The left inner surface 21D has the same size as that of the left surface 20F of the light guide member 20, and extends parallel to the left surface 20F.

The front inner surface 21A, the upper inner surface 21B, the lower inner surface 21C and the left inner surface 21D are, for example, painted with white or plated so as to satisfactorily reflect (diffuse) light. The cover 21 itself may be made of a white resin.

As shown in FIG. 1, the front surface of the cover 21 is connected to the housing 2 so that the discharger 10 (excluding the light source 22) is supported by the housing 2 and forms a part of the process cartridge 1. In detail, the cover 21 is formed as a part of the housing 2 integrally with the housing 2.

As shown in FIG. 2(*c*), the light guide member 20 is accommodated in the inner space 23 of the cover 21. In this case, as shown in FIG. 3, the front surface 20A of the light guide member 20 is disposed at the back side of the front inner surface 21A of the cover 21 to be opposed thereto, the upper surface 20C of the light guide member 20 is disposed at the lower side of the upper inner surface 21B of the cover 21 to be opposed thereto, the lower surface 20D of the light guide member 20 is disposed at the upper side of the lower inner surface 21C of the cover 21 to be opposed thereto, and the left surface 20F of the light guide member 20 at the right side of the left inner surface 21D of the cover 21 to be opposed thereto. In addition, the back surface 20B of the light guide member 20 is exposed to the back side from the notched back surface of the cover 21, and the right surface 20E of the light guide member 20 is exposed to the right side from the notched right surface of the cover 21. In other words, when the light guide member 20 and the cover 21 are integrated with each other, the cover 21 covers the light guide member 20 to expose at least the back surface 20B opposed to the photoconductive drum 7 (see FIG. 2(*a*)).

The light source 22 is disposed at the right side of the light guide member 20 as shown in FIG. 2(*b*) and FIG. 2(*c*), and is supported by the image forming apparatus casing side (not shown) described above. The light source 22 is disposed at the right side of the right surface 20E of the light guide member 20 to be opposed thereto with a distance (see also FIG. 3). The left surface 20F of the light guide member 20 is disposed at a position further distant from the light source 22 toward the left side than the right surface 20E.

As described above, the light guide member 20 is long in the width direction, and is disposed at the front side of the photoconductive drum 7 to be opposed to the outer peripheral surface of the photoconductive drum 7. The light source 22 is disposed at the right side of the light guide member 20, in particular, alongside the photoconductive drum 7 in the central axis direction (width direction) of the photoconductive drum 7 in the image forming apparatus casing (not shown). In this state, the light source 22 can emit light to the left side along the width direction. In other words, as shown in FIG. 2(*b*), the optical axis 22A of the light source 22 (optical axis direction) extends in the width direction, and is parallel to the central axis of the photoconductive drum 7 (see FIG. 2(*c*)). Here, as described above, the opening cross-sectional areas of the holes 25 (that is, the areas of the surfaces 25A) are so determined that a hole 25, closer to the left end of the light guide member 20, has a larger opening cross-sectional area, and in other words, a hole 25, more distant from the light source 22, has a larger cross-sectional area of the holes 25 (a larger area of the surfaces 25A).

The discharger 10 thus configured is actuated after the toner image is transferred from the photoconductive drum 7 onto the recording medium 11 as described above.

In detail, referring to FIG. 2(*c*), after transfer of the toner image, the light source 22 emits light, and light from the light source 22 travels to the left side along the width direction. This light is made incident on the right surface 20E of the light guide member 20 to enter into the light guide member 20, and continuously travels to the left side along the width direction inside the light guide member 20. Since the cover 21 covers the light guide member 20 to expose at least the back surface 20B to the photoconductive drum 7 at the back side as described above, a part of light incident on the right surface 20E and traveling to the left side inside the light guide member 20 naturally leaks to the back side from the back surface 20B of the light guide member 20. The light which thus naturally leaks to the back side includes light which is reflected by the inner surfaces of the cover 21 (the front inner surface 21A, the upper inner surface 21B, the lower inner surface 21C, and the left inner surface 21D) during traveling and travels to the back side from the back surface 20B.

Light nearly reaching the hole 25 of the light traveling to the left side inside the light guide member 20 strikes the surface 25A defining the hole 25 and is diffused (reflected) and its traveling direction is accordingly changed. In detail, the surface 25A is curved into a circular shape as viewed from above (see also FIG. 5), and therefore the light nearly reaching the hole 25 is diffused radially over the entire circumferential region of the surfaces 25A. Because the cover 21 covers the light guide member 20 to expose at least the back surface 20B to the photoconductive drum 7 at the back side as described above, the diffused light is reflected by the inner surfaces of the cover 21 (the front inner surface 21A, the upper inner surface 21B, and the left inner surface 21D) and accordingly turned toward the back side, and thereafter, passes through the back surface 20B and travels toward the back side. Herein, light directly diffused to the back side of the light by the surface 25A continuously travels to the back side through the back surface 20B without being reflected by the inner surfaces of the cover 21. Thus, the light incident on the right surface 20E from the light source 22 is reflected by the surface 25A of the hole 25 toward the photoconductive drum 7.

The light thus naturally leaking to the back side from the back surface 20B during traveling and the light which is diffused by the surface 25A of the hole 25 and travels to the back side are combined and continuously travel to the back side, and are irradiated onto the outer peripheral surface of the photoconductive drum 7. By irradiating light from the light guide member 20 onto the outer peripheral surface of the photoconductive drum 7, the irradiated portion of the photoconductive drum 7 is exposed, and therefore charge remaining on this portion is eliminated.

Here, the more distant from the light source 22, the harder it is for the light from the light source 22 to reach. Therefore, it is harder for the light incident into the inside of the light guide member 20 to reach the region more distant from the light source 22 and closer to the left end of the light guide member 20. Accordingly, the amount of light naturally leaking to the back side from the back surface 20B of the light guide member 20 during traveling may become smaller as the light travels more distant from the light source 22 toward the left end of the light guide member 20. In this case, the amount of light (irradiation amount) irradiated from the light guide member 20 onto the photoconductive drum 7 may become smaller at a position more distant from the light source 22 and closer to the left end of the light guide member 20.

The holes 25 as described above can function to prevent the irradiation amount from becoming smaller at a position more distant from the light source 22. In detail, as described above, the closer the left end of the light guide member 20 (the more distant from the light source 22) the holes 25 are located, the larger the opening cross-sectional areas (surfaces 25A) of the holes 25 (see also FIG. 5), and therefore the surface 25 of the hole 25, more distant from the light source 22 and closer to the left end of the light guide member 20, can diffuse more part of light traveling inside the light guide member 20 the surfaces 25A o. Therefore, even if the amount of light naturally leaking to the back side from the back surface 20B of the light guide member 20 during traveling becomes smaller toward the left side away from the light source, the amount of light which is diffused by the surfaces 25A of the holes 25A at positions away from the light source 22 increases instead.

Accordingly, even if the light travels toward the left side away from the light source 22, the total of the amount of light naturally leaking to the back side from the back surface 20B during traveling and the amount of light diffused by the surfaces 25A of the holes 25 to the back side can be made substantially constant, and therefore the irradiation amount of light onto the photoconductive drum 7 from the light guide member 20 becomes substantially uniform across the width direction. Accordingly, with this discharger 10, charge remaining on the outer peripheral surface of the photoconductive drum 7 can be eliminated uniformly in the width direction.

The light guide member 20 is configured to guide the light from the light source 22 and to irradiate the light onto the entire region, in the width direction, of the photoconductive drum 7. Then, in this state, by rotating the photoconductive drum 7 after transferring the toner image, light from the light guide member 20 is irradiated onto the entire region, in the circumferential direction, of the photoconductive drum 7. Accordingly, finally, charge remaining on the outer peripheral surface of the photoconductive drum 7 is eliminated uniformly.

Figure 6A:
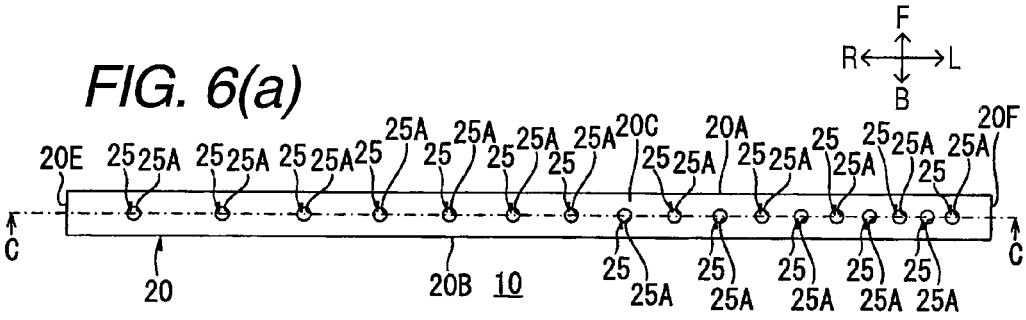
FIG. 6(*a*) is a plan view of a light guide member of a second example, and FIG. 6(*b*) is a sectional view along the arrow C-C of FIG. 6(*a*).
Figure 6B:
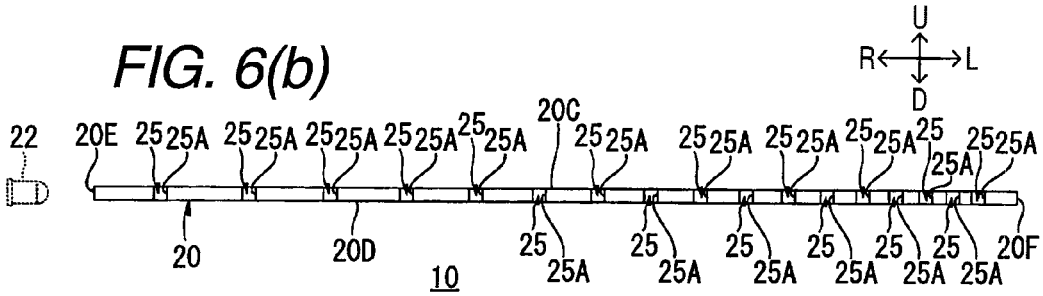
Figure 7:
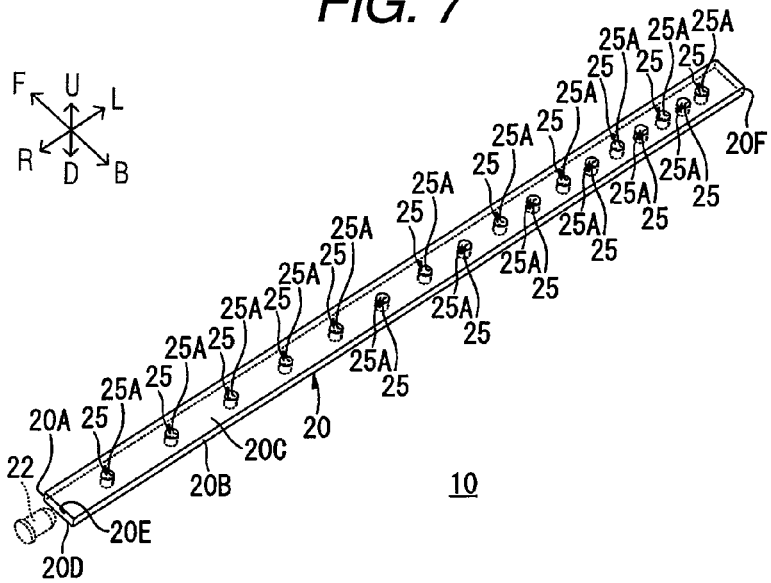
FIG. 7 is a perspective view of the light guide member of FIG. 6 from the back side.
Figure 8A:
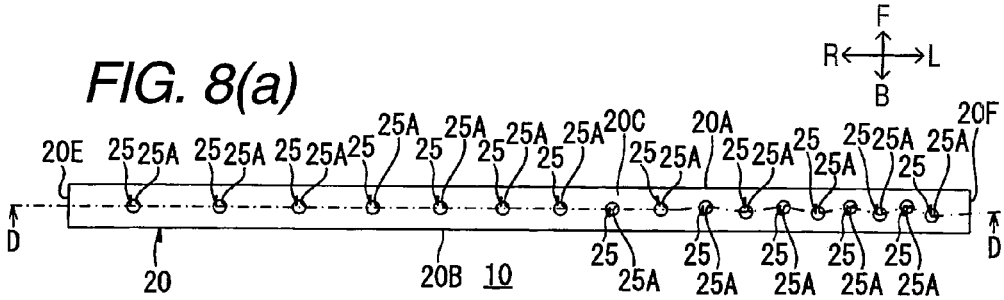
FIG. 8(*a*) is a plan view of a light guide member of a third example, and FIG. 8(*b*) is a sectional view along the arrow D-D of FIG. 8(*a*).
Figure 8B:
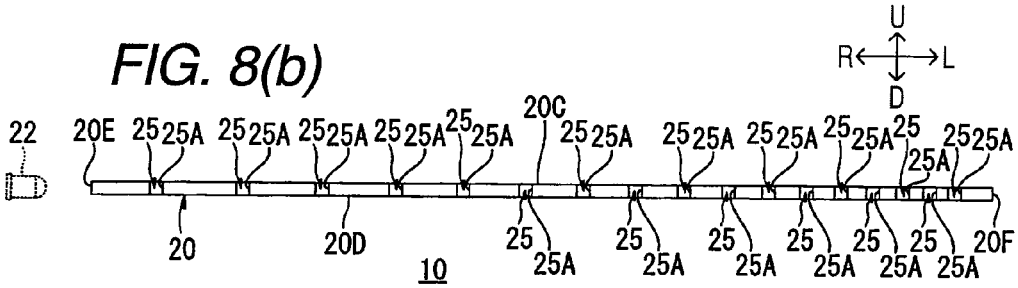
Figure 9:
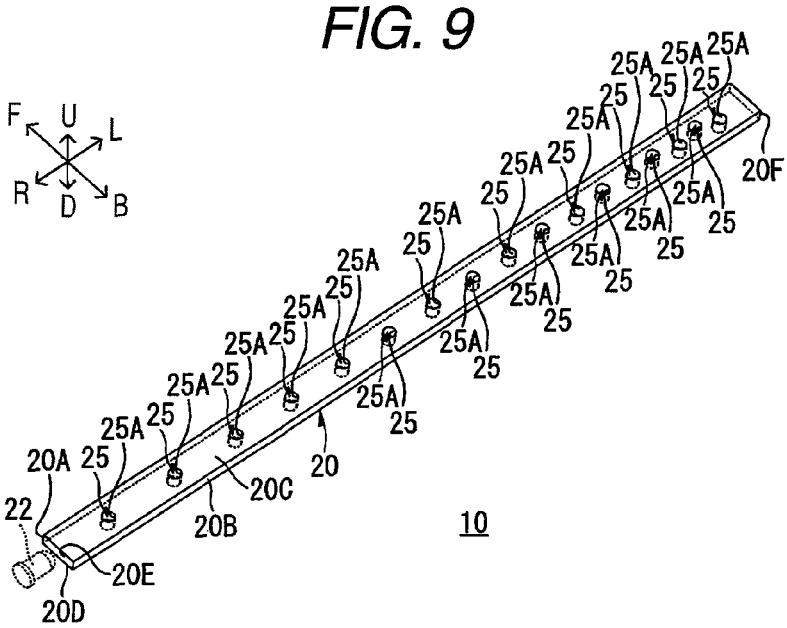
FIG. 9 is a perspective view of the light guide member of FIGS. 8 from the back side.
Figure 10A:
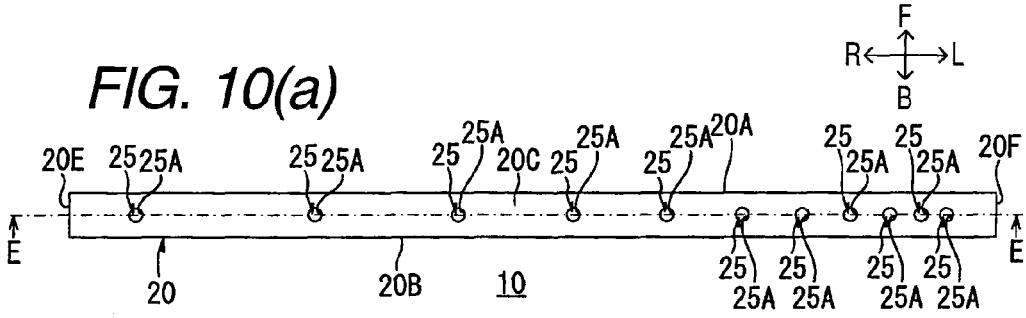
FIG. 10(*a*) is a plan view of a light guide member of a fourth example, and FIG. 10(*b*) is a sectional view along the arrow E-E of FIG. 10(*a*).
Figure 10B:
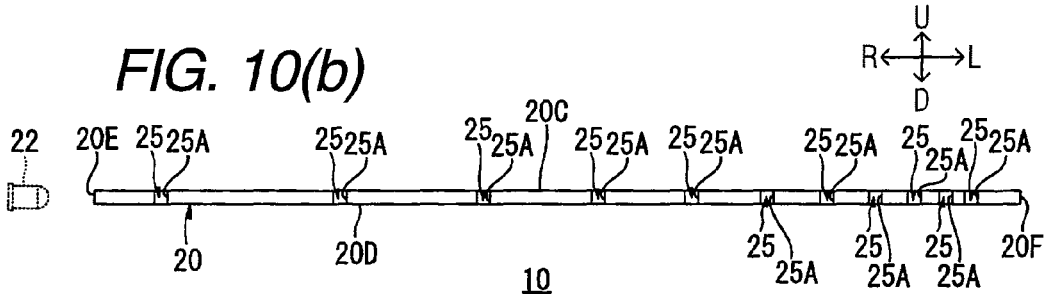
Figure 11:
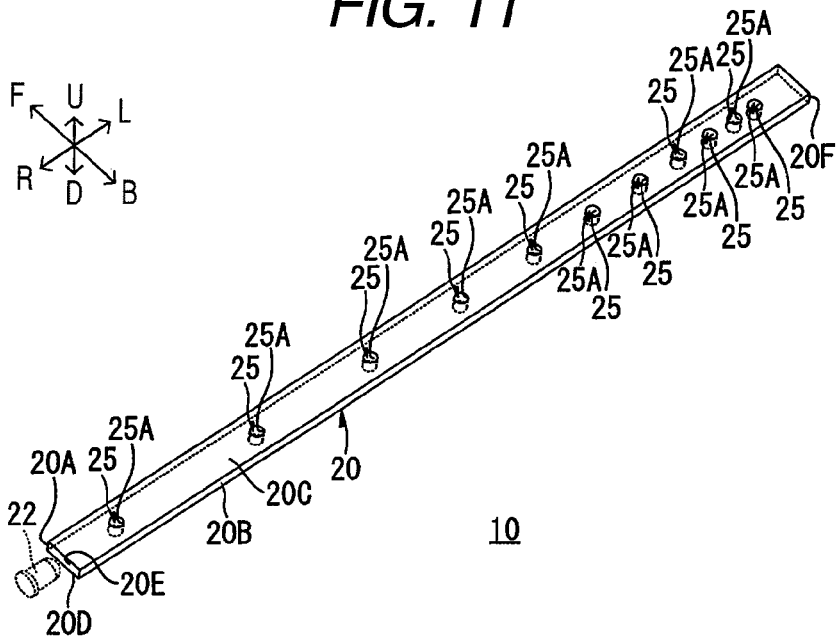
FIG. 11 is a perspective view of the light guide member of FIG. 10 from the back side.
Figure 12:
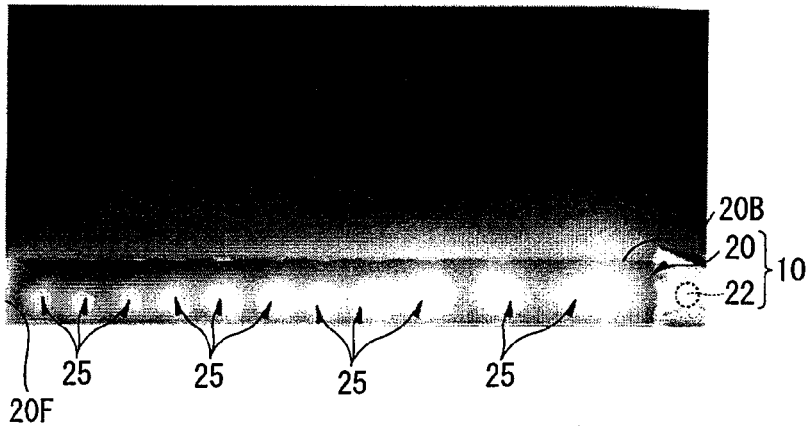
FIG. 12 is a photo showing actual irradiation of light from the light guide member of the fourth example.

FIG. 6(*a*) is a plan view of a light guide member of a second example, and FIG. 6(*b*) is a sectional view along the arrow C-C of FIG. 6(*a*). FIG. 7 is a perspective view of the light guide member as viewed from the back side. FIG. 8(*a*) is a plan view of a light guide member of a third example, and FIG. 8(*b*) is a sectional view along the arrow D-D of FIG. 8(*a*). FIG. 9 is a perspective view of the light guide member of FIGS. 8 as viewed from the back side. FIG. 10(*a*) is a plan view of a light guide member of a fourth example, and FIG. 10(*b*) is a sectional view along the arrow E-E of FIG. 10(*a*). FIG. 11 is a perspective view of the light guide member of FIG. 10 as viewed from the back side. FIG. 12 is a photo showing actual irradiation of light from the light guide member of the fourth example.

In the light guide member 20 of the first example described above, a plurality of holes 25 are formed at even intervals along the width direction, and the hole 25, closer to the left end (more distant from the light source 22), has the larger opening cross-sectional area (surfaces 25A) (see FIGS. 4(*a*) and 4(*b*) and FIG. 5).

Alternatively, the light guide member 20 of the second example as shown in FIGS. 6(*a*), 6(*b*) and FIG. 7 can also be applied. The light guide member 20 of the second example is formed with a plurality of holes 25 similar to the light guide member 20 of the first example, a, however, the opening cross-sectional areas (surfaces 25A) of the holes 25 are equal among all holes 25. In the light guide member 20 of the second example, the intervals between holes 25 adjacent to each other in the width direction become smaller toward the left side as the holes 25 are located more distant from the light source 22. In other words, according to the light guide member 20 of the second example, at a position distant from the light source 22, a larger number of holes 25 are formed than at a position near the light source 22.

To form a larger number of holes 25 at a position distant from the light source 22, as shown in the light guide member 20 of the third example of FIGS. 8(*a*) and 8(*b*) and FIG. 9, the holes 25 at a position distant from the light source 22 may be staggered so that the holes 25 adjacent to each other in the left and right direction are offset from each other in the front-back direction.

The first example and the second example may be combined. That is, a hole 25, more distant from the light source 22 and closer to the left end of the light guide member 20, has a larger opening cross-sectional area (larger surface 25A), and such holes 25 are arranged so that an interval between adjacent holes 25 in the width direction is smaller as the holes 25 are located more distant from the light source 22 and closer to the left end of the light guide member 20.

As shown in the fourth example of FIGS. 10(*a*) and 10(*b*) and FIG. 11, the number of holes 25 may be increased or decreased as appropriate (the number of holes 25 in the fourth example is smaller than that in the second example).

Then, among the light guide members 20 of the examples of the above-described embodiment, for example, when the light guide member 20 of the fourth example is used, as shown in FIG. 12, the irradiation amount of light irradiated to the back side (upper side of FIG. 12) toward the photoconductive drum 7 from the back surface 20B of the light guide member 20 is substantially uniform in the width direction (right-left direction of FIG. 12).

<Operation and Effect>

(1) As shown in FIG. 2(*c*), the light guide member 20 extending in the width direction along the central axis of the photoconductive drum 7 is opposed to the outer peripheral surface of the photoconductive drum 7, and the light source 22 is disposed alongside the photoconductive drum 7 in the central axis direction (width direction). Light from the light source 22 is irradiated onto the photoconductive drum 7 across the central axis direction while being guided along the central axis direction of the photoconductive drum 7 by the light guide member 20. Accordingly, the outer peripheral surface of the photoconductive drum 7 is exposed, and charge on the outer peripheral surface of the photoconductive drum 7 is eliminated across the central axis direction.

Here, in the light guide member 20, a plurality of holes 25 defined by the surfaces 25A at least portions of which are curved are formed. Each hole 25 extends in an orthogonal direction (up-down direction) substantially orthogonal to the central axis direction of the photoconductive drum 7 and the opposing direction of the photoconductive drum 7 to the light guide member 20 (see FIG. 2(*a*) and FIG. 2(*b*)). Accordingly, each hole 25 is arranged such that, not the opening end of the hole 25 but the surface 25A of the hole 25 is opposed to the photoconductive drum 7.

Light nearly reaching the hole 25 from the light source 22 strikes the curved portion of the surface 25A defining the hole 25A and diffuses, and accordingly, its traveling direction is changed toward the photoconductive drum 7, and the light is positively irradiated onto the photoconductive drum 7. In other words, by forming the hole 25 in the light guide member 20, the surface 25A of the hole 25 functions as a light emitter by receiving light from the light source 22 and can irradiate the light positively onto the photoconductive drum 7. Therefore, by arranging such holes 25 along the central axis direction of the photoconductive drum 7, the light can be irradiated onto the photoconductive drum 7 uniformly across the central axis direction, and therefore charge on the outer peripheral surface of the photoconductive drum 7 can be eliminated uniformly across the central axis direction of the photoconductive drum 7.

In other words, with a simple configuration in which such holes 25 are formed in the light guide member 20, charge on the outer peripheral surface of the photoconductive drum 7 can be eliminated uniformly across the central axis direction of the photoconductive drum 7.

The hole 25 of the above-described embodiment is a circular hole, however, the hole may not be the circular hole, and the hole may be, for example, an oval hole or may partially have a flat surface as long as at least a portion of the surface 25A defining the hole 25 is curved.

(2) The plurality of holes 25 are arranged at intervals in the central axis direction of the photoconductive drum 7. Therefore, the light guide member 20 can uniformly irradiate light from the light source 22 onto the entire region in the central axis direction of the photoconductive drum 7, and charge on the outer peripheral surface of the photoconductive drum 7 can be eliminated uniformly across the central axis direction.

(3) In the light guide member 20 of the first example of FIGS. 2(*a*) to FIG. 5, the more distant from the light source 22 the hole 25 is located, the larger the area of the surface 25A the hole 25 has. The hole 25, which is distant from the light source 22 and light hardly sufficiently reaches, has the surface 25A which can reliably diffuse the light reaching from the light source 22 to positively irradiate it onto the photoconductive drum 7. Accordingly, the light irradiation amount onto the photoconductive drum 7 from the light guide member 20 can be restrained from becoming smaller with distance from the light source 22 in the central axis direction of the photoconductive drum 7. Therefore, the light guide member 20 can uniformly irradiate the light from the light source 22 onto the entire region, in the central axis direction, of the photoconductive drum 7, so that charge on the outer peripheral surface of the photoconductive drum 7 can be eliminated uniformly across the central axis direction.

(4) In the light guide member 20 of the second to fourth examples shown in FIGS. 6(*a*) to FIG. 11, the intervals between the holes 25 adjacent to each other become smaller as the distance from the light source 22 increases. Accordingly, at a position distant from the light source 22 where the light hardly sufficiently reaches, more holes 25 are formed. Accordingly, at a position distant from the light source 22, the light reaching from the light source 22 is continuously irradiated onto the photoconductive drum 7 by the surfaces 25A of many holes 25 frequently, so that the light irradiation amount onto the photoconductive drum 7 from the light guide member 20 can be restrained from becoming smaller as the distance from the light source 22 along the central axis direction of the photoconductive drum 7 increases. Therefore, the light guide member 20 can uniformly irradiate the light from the light source 22 onto the entire region, in the central axis direction, of the photoconductive drum 7, so that charge on the outer peripheral surface of the photoconductive drum 7 can be eliminated uniformly across the central axis direction.

(5) As shown in FIG. 2(*a*), the cover 21 covers the light guide member 20 so that at least the back surface 20B of the light guide member 20 opposed to the photoconductive drum 7 is exposed to the photoconductive drum 7, so that the light guide member 20 can concentrate light from the light source 22 on the back surface 20B and irradiate it onto the photoconductive drum 7 from the back surface 20B without leakage. Accordingly, charge on the outer peripheral surface of the photoconductive drum 7 can be effectively eliminated.

(6) The surface 25A is a rough surface, so that light nearly reaching the holes 25 from the light source 22 can be effectively diffused and positively irradiated onto the photoconductive drum 7.

(7) The hole 25 penetrates through the light guide member 20 in the orthogonal direction (up-down direction). Accordingly, the hole 25 can be formed by easy machining without regard for its depth. Of course, the hole 25 may be formed so as not to penetrate through the light guide member 20 if this is not troublesome.

(8) As shown in FIG. 3, the light guide member 20 includes a right surface 20E on which light from the light source 22 is made incident, and a left surface 20F which is disposed at a position further distant from the light source 22 than the right surface 20E and opposed to the right surface 20E. The light guide member 20 extends in a direction crossing the right surface 20E and the left surface 20F, and includes a back surface 20B opposed to the photoconductive drum 7, and a front surface 20A which is disposed at a position further distant from the photoconductive drum 7 than the back surface 20B and opposed to the back surface 20B (see FIG. 2(*c*)). Further, the light guide member 20 includes an upper surface 20C which connects one end (upper end) of the back surface 20B and one end (upper end) of the front surface 20A, and a lower surface 20D which connects the other end (lower end) of the back surface 20B and the other end (lower end) of the front surface 20A.

As shown in FIG. 2(*c*), this light guide member 20 includes the surfaces 25A between the back surface 20B and the front surface 20A. Light incident on the right surface 20E from the light source 22 can be reflected by the surfaces 25A toward the photoconductive drum 7. Accordingly the surfaces 25A can be provided by effectively using the space between the back surface 20B and the front surface 20A.

<Exemplary Variation>

In the above-described embodiment, as shown in FIG. 2(*a*), the shape (right side sectional shape) of the light guide member 20 as viewed in the width direction is a rectangular shape whose four sides extend along either the up-down or front-back direction, and which is long in the front-back direction. In other words, the light guide member 20 of the embodiment described above has the front surface 20A, the back surface 20B, the upper surface 20C, and the lower surface 20D which are flat surfaces extending along either the up-down or front-back direction.

Here, the right side sectional shape of the light guide member 20 may not be the rectangular shape long in the front-back direction, and may be a square shape. In other words, the light guide member 20 may not have a flat-plate shape thin in the up-down direction.

Further, the back surface 20B may have an arc shape swelling to the back side. In the light guide member 20, the back surface 20B is curved like an arc swelling to the back side and performs a function as a lens, and as described above, light irradiated to the back side toward the photoconductive drum 7 from the light guide member 20 can be irradiated on the photoconductive drum 7 in a condensed manner without being diffused radially.

Figure 13A:
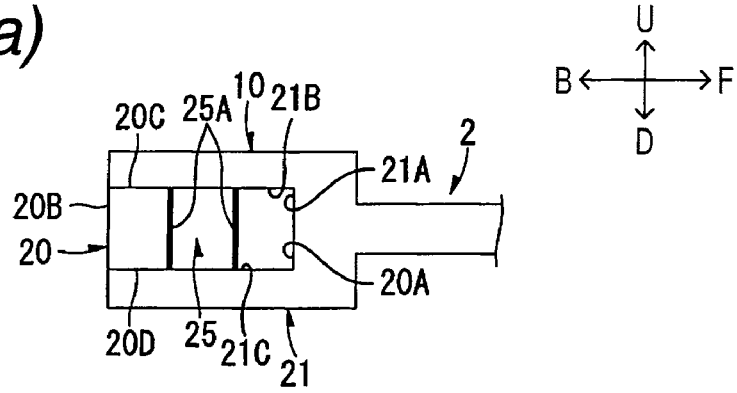
FIG. 13(*a*) is an enlarged view showing a portion of FIG. 1, FIGS. 13(*b*) and 13(*c*) are enlarged views in which exemplary variations are applied to the portion of FIG. 1.
Figure 13B:
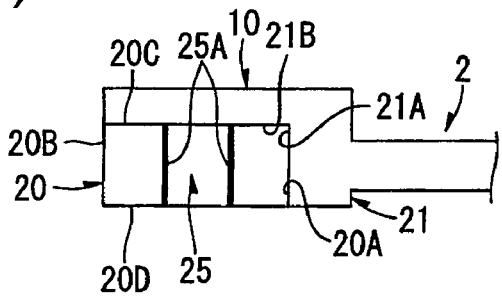
Figure 13C:
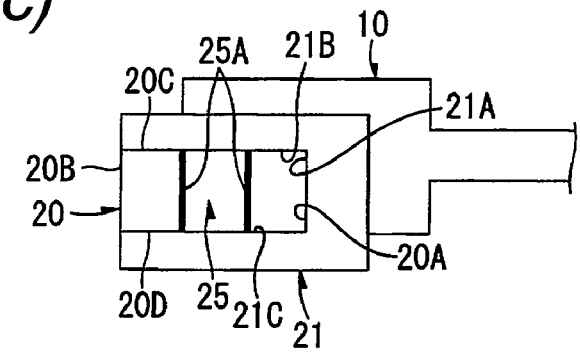

FIG. 13(*a*) is an enlarged view showing a portion of FIG. 1 and FIGS. 13(*b*) and (*c*) are enlarged views in which the exemplary variations are applied to the portion of FIG. 1.

In the embodiment described above, the cover 21 covers the light guide member 20 so that only the back surface 20B and the right surface 20E are exposed (see FIG. 3), and is formed as a part of the housing 2 integrally with the housing 2 (see FIG. 1 and FIG. 13(*a*)).

Alternatively, the cover 21 may cover the light guide member 20 so that the lower surface 20D is exposed as well as the back surface 20B and the right surface 20E as shown in FIG. 13(*b*).

As shown in FIG. 13(*c*), the cover 21 may be configured separately from the housing 2.

In the embodiments described above, a laser printer configured to form an electrostatic latent image by exposing the photoconductive drum 7 by a laser is illustrated, however, the present invention is also applicable to all types of electrophotographic image forming apparatuses which perform image formation by forming an electrostatic latent image on a charged photoconductive drum or a charged photoconductive belt.

As discussed above, the present invention can provide at least the following illustrative, non-limiting embodiments:

(1) A discharger configured to eliminate charge from an outer peripheral surface of a photoconductor, the discharger including: a light source disposed alongside the photoconductor in a central axis direction of the photoconductor; a light guide member which is opposed to the outer peripheral surface of the photoconductor, extends along the central axis of the photoconductor, and guides light from the light source so as to irradiate the light onto the photoconductor across the central axis direction, wherein the light guide member includes a plurality of holes that are defined by hole surfaces, at least portions of which are curved, and that extend in an orthogonal direction substantially orthogonal to the central axis direction of the photoconductor and a direction in which the light guide member is opposed to the outer peripheral surface of the photoconductor.

(2) The discharger according to (1), wherein the plurality of holes are arranged at intervals in the central axis direction of the photoconductor.

(3) The discharger according to (2), wherein the interval between the holes adjacent to each other become smaller as the holes are located farther from the light source.

(4) The discharger according to (2) or (3), wherein surface areas of the holes become larger as the holes are located farther from the light source.

(5) The discharger according to any one of (1) to (4), further including a cover which covers the light guide member so that at least an opposed surface of the light guide member is opposed and exposed to the photoconductor.

(6) The discharger according to any one of (1) to (5), wherein each of the hole surfaces is a rough surface.

(7) The discharger according to any one of (1) to (6), wherein each of the holes penetrates through the light guide member in the orthogonal direction.

(8) A process cartridge to be installed in an image forming apparatus, the process cartridge including: a photoconductor; and a light guide member which is opposed to an outer peripheral surface of the photoconductor, extends along a central axis of the photoconductor, and guides light from a light source disposed alongside the photoconductor in the central axis direction in the image forming apparatus, so as to irradiate the on the photoconductor across the central axis direction, wherein the light guide member includes a plurality of holes that are defined by hole surfaces at least portions of which are curved, and that extend in an orthogonal direction substantially orthogonal to the central axis direction of the photoconductor and a direction in which the light guide member is opposed to the outer peripheral surface of the photoconductor.

(9) The process cartridge according to (8), wherein the plurality of holes are arranged at intervals in the central axis direction of the photoconductor.

(10) The process cartridge according to (9), wherein the intervals between the holes adjacent to each other become smaller as the holes are located farther from the light source.

(11) The process cartridge according to (9) or (10), wherein surface areas of the holes become larger as the holes are located farther from the light source.

(12) The process cartridge according to any one (8) to (11), further including a cover which covers the light guide member so that at least an opposed surface of the light guide member is opposed and exposed to the photoconductor.

(13) The process cartridge according to any one of (8) to (12), wherein each of the hole surfaces is a rough surface.

(14) The process cartridge according to any one of (8) to (13), wherein each of the holes penetrates through the light guide member in the orthogonal direction.

(15) A process cartridge to be installed in an image forming apparatus, comprising: a photoconductive drum; and a light guide member which is opposed to an outer peripheral surface of the photoconductor, and guides light from a light source disposed alongside the photoconductor in a central axis direction of the photoconductive drum in the image forming apparatus, so as to irradiate the light onto the photoconductor across the central axis direction, wherein the light guide member includes: an incidence surface on which light from the light source is incident; an incidence opposed surface which is disposed at a position farther from the light source than the incidence surface, and is opposed to the incidence surface; a first surface which extends in a direction crossing the incidence surface and the incidence opposed surface, and is opposed to the photoconductor; a second surface which is disposed at a position farther from the photoconductor than the first surface, and is opposed to the first surface; a third surface which connects one end of the first surface and one end of the second surface; a fourth surface which connects the other end of the first surface and the other end of the second surface; and a reflecting surface which is disposed between the first surface and the second surface and configured to reflect light from the light source incident on the incidence surface toward the photoconductor.

According to the discharger of (1) and the cartridge of (8), the light guide member extending along the central axis of the photoconductor is opposed to the outer peripheral surface of the photoconductor, and the light source is disposed alongside the photoconductor in the central axis direction. Light from the light source is irradiated on the photoconductor across the central axis direction while being guided by the light guide member in the central axis direction of the photoconductor. Accordingly, the outer peripheral surface of the photoconductor is exposed, and charge on the outer peripheral surface of the photoconductor is eliminated therefrom across the central axis direction.

Here, the light guide member includes a plurality of holes defined by surfaces, at least portions of which are curved.

Each hole extends in an orthogonal direction substantially orthogonal to the central axis direction of the photoconductor and a direction in which the light guide member is opposed to the outer peripheral surface of the photoconductor. Each hole is arranged so that not an opening end of the hole but the hole surface of the hole is opposed to the photoconductor.

Light which nearly reaches the hole from the light source strikes the curved portion of the hole surface and diffuses, and accordingly, its traveling direction is changed toward the photoconductor, and the light is positively irradiated on the photoconductor. In other words, by forming the hole in the light guide member, the hole surface of the hole can serve as a light emitter by receiving light from the light source. The light can be positively irradiated onto the photoconductor. Therefore, by arranging such holes along the central axis direction of the photoconductor, light can be irradiated onto the photoconductor uniformly across the central axis direction. Consequently, the charge on the outer peripheral surface of the photoconductor can be eliminated therefrom uniformly across the central axis direction of the photoconductor.

In other words, by a simple configuration in which such holes are formed in the light guide member, charge on the outer peripheral surface of the photoconductor can be eliminated therefrom uniformly across the central axis direction of the photoconductor.

According to discharger of (2) and the cartridge of (9), a plurality of holes is arranged at intervals in the central axis direction of the photoconductor. Therefore, the light guide member can uniformly irradiate light from the light source onto the entire region, in the central axis direction, of the photoconductor. Consequently, charge on the outer peripheral surface of the photoconductor can be eliminated therefrom uniformly across the central axis direction.

According to the discharger of (3) and the cartridge of (10), the intervals between adjacent holes become smaller as the holes are located farther from the light source. Therefore, more holes are formed in a region of the light guide member distant from the light source where the light hardly sufficiently reaches. Accordingly, in the region distant from the light source, light reaching from the light source is continuously irradiated onto the photoconductor frequently by the hole surfaces of many holes. Accordingly, the light irradiation amount onto the photoconductor from the light guide member can be restrained from becoming smaller as the distance from the light source along the central axis direction of the photoconductor is larger. Therefore, the light guide member can uniformly irradiate the light from the light source onto the entire region, in the central axis direction, of the photoconductor. Consequently, charge on the outer peripheral surface of the photoconductor can be eliminated therefrom uniformly across the central axis direction.

According to the discharger of (4) and the cartridge of (11), Surface areas of the holes become larger as the holes are located farther from the light source. The hole distant from the light source where light hardly satisfactorily reaches has the hole surface having large surface area, and therefore the hole surface can reliably diffuse the light reaching from the light source and positively irradiate the light onto the photoconductor. Accordingly, the light irradiation amount onto the photoconductor from the light guide member can be restrained from becoming smaller as the distance from the light source along the central axis direction of the photoconductor is larger. Therefore, the light guide member can uniformly irradiate light from the light source onto the entire region, in the central axis direction, of the photoconductor. Consequently, charge on the outer peripheral surface of the photoconductor can be eliminated therefrom uniformly across the central axis direction.

According to the discharger of (5) and the cartridge of (12), the cover covers the light guide member so that at least the opposed surface is opposed and exposed to the photoconductor. With the light guide member, light from the light source can be concentrated to the opposed surface and irradiated onto the photoconductor from the opposed surface without leakage. Accordingly, charge on the outer peripheral surface of the photoconductor can be effectively eliminated therefrom.

According to the discharger of (6) and the cartridge of (13), each of the hole surface is a rough surface. Accordingly, light nearly reaching the hole from the light source can be effectively diffused and positively irradiated onto the photoconductor.

According to the discharger of (7) and the cartridge of (14), each of the hole penetrates through the light guide member in the orthogonal direction. Accordingly, the hole can be formed by easy machining without regard for its depths.

According to the cartridge of (15), the light guide member is opposed to the outer peripheral surface of the photoconductor. Light from the light source disposed alongside the photoconductor in the central axis direction is irradiated on the photoconductor across the central axis direction while being guided by the light guide member along the central axis direction of the photoconductor. Accordingly, the outer peripheral surface of the photoconductor is exposed, and charge on the outer peripheral surface of the photoconductor is eliminated across the central axis direction.

Here, the light guide member includes an incidence surface on which light from the light source is incident, and an incidence opposed surface which is disposed at a position farther from the light source than the incidence surface and opposed to the incidence surface. The light guide member further includes a first surface which extends in a direction crossing the incidence surface and the incidence opposed surface and is opposed to the photoconductor, and a second surface which is disposed at a position farther from the photoconductor than the first surface and opposed to the first surface. The light guide member further includes a third surface which connects one end of the first surface and one end of the second surface, and a fourth surface which connects the other end of the first surface and the other end of the second surface.

The light guide member further includes a reflecting surface which is disposed between the first surface and the second surface and reflects light, incident on the incident surface from the light source, toward the photoconductor. Accordingly, the reflecting surface can be provided by effectively using a space between the first surface and the second surface.

What is claimed is:

1. A discharger configured to eliminate charge from a surface of a photoconductor, the discharger comprising:

a light source;

a light guide member which extends in a first direction across a width of the photoconductor to be opposed to the surface of the photoconductor in a second direction substantially orthogonal to the first direction, and which is configured to guide light from the light source to the photoconductor, wherein the light guide member has a plurality of holes, each defined by a hole surface, the hole surface being a rough surface of approximately 12.5 to 25 Rz, at least a portion of the hole surface is curved, and the hole extends in an orthogonal direction substantially orthogonal to the first and second directions.

2. The discharger according to claim 1, wherein the holes are arranged at intervals in the first direction.

3. The discharger according to claim 2, wherein the interval between the adjacent holes becomes smaller as distance of the adjacent holes from the light source increases.

4. The discharger according to claim 2, wherein the hole, more distant from the light source, has a larger area of hole surface.

5. The discharger according to claim 1, comprising a cover which covers the light guide member so that at least an opposed surface of the light guide member is opposed and exposed to the photoconductor.

6. The discharger according to claim 1, wherein the hole penetrates through the light guide member in the orthogonal direction.

7. A process cartridge to be installed in an image forming apparatus, the process cartridge comprising:

a photoconductor; and a light guide member which extends in a first direction to be opposed to a surface of the photoconductor in a second direction substantially orthogonal to the first direction, and which is configured to guide light from a light source to the photoconductor, wherein the light guide member has a plurality of holes, each defined by a hole surface, the hole surface being a rough surface of approximately 12.5 to 25 Rz, at least a portion of the hole surface is curved, and the hole extends in an orthogonal direction substantially orthogonal to the first and second directions.

8. The process cartridge according to claim 7, wherein the holes are arranged at intervals in the first direction.

9. The process cartridge according to claim 8, wherein the interval between the adjacent holes becomes smaller as distance of the adjacent holes from the light source increases.

10. The process cartridge according to claim 8, wherein the hole, more distant from the light source, has a larger area of the hole surface.

11. The process cartridge claim 7, comprising a cover which covers the light guide member so that at least an opposed surface of the light guide member is opposed and exposed to the photoconductor.

12. The process cartridge according to claim 7, wherein the hole penetrates through the light guide member in the orthogonal direction.

* * * * *